US006334233B1

(12) United States Patent
Roberts et al.

(10) Patent No.: US 6,334,233 B1
(45) Date of Patent: Jan. 1, 2002

(54) VACUUM CLEANER WITH SNAP-FIT HANDLE AND TORQUE-REDUCING SUPPORT

(75) Inventors: Kenneth L. Roberts, Rockford; Gary L. Steinberg, Jenison, both of MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 09/475,935

(22) Filed: Dec. 30, 1999

Related U.S. Application Data

(60) Provisional application No. 60/114,485, filed on Dec. 31, 1998.

(51) Int. Cl.[7] ..... A47L 9/32

(52) U.S. Cl. ..... 15/323; 15/350; 15/351; 15/410

(58) Field of Search ..... 15/350, 351, 410, 15/323

(56) References Cited

U.S. PATENT DOCUMENTS

| | | | | | |
|---|---|---|---|---|---|
| 2,660,457 | A | * | 11/1953 | Mallon | 15/410 X |
| 2,923,960 | A | * | 2/1960 | Davidson | 15/410 |
| 4,129,920 | A | * | 12/1978 | Evans et al. | 15/410 X |
| 4,621,390 | A | | 11/1986 | Hampton et al. | |
| 4,662,026 | A | * | 5/1987 | Sumerau et al. | 15/410 X |
| 5,216,779 | A | * | 6/1993 | Glenn | 15/410 X |
| 5,230,121 | A | * | 7/1993 | Blackman | 15/410 |
| 5,309,600 | A | | 5/1994 | Weaver et al. | |
| 5,367,741 | A | * | 11/1994 | Hampton et al. | 15/410 X |
| D381,143 | S | | 7/1997 | Luebbering | |
| 6,108,862 | A | * | 8/2000 | Frederick et al. | 15/410 X |

FOREIGN PATENT DOCUMENTS

| | | |
|---|---|---|
| WO | WO 94/17716 | 8/1994 |

* cited by examiner

*Primary Examiner*—Chris K. Moore
(74) *Attorney, Agent, or Firm*—Rader, Fishman, Grauer & McGarry

(57) ABSTRACT

A vacuum cleaner having an improved structural handle/support assembly for supporting a vacuum cleaner module. The handle/support assembly has a primary support member, a secondary support member and a snap-in handle section. The primary and secondary support member cooperate to form an integrated support structure that reduces torquing of the vacuum cleaner module relative to the handle/support assembly during use. Further, the primary and secondary support members define an aperture to accommodate rearwardly extending vacuum hose. The handle section includes an open base portion that includes one or more slots therein. A handle mounting portion of the primary support member having one or more integral tabs formed therein is telescopically received within the base portion of the handle section. The one or more slots in the handle section receive the one or more tabs of the handle mounting portion in snap-fit engagement.

25 Claims, 5 Drawing Sheets

VACUUM CLEANER WITH SNAP-FIT HANDLE AND TORQUE-REDUCING SUPPORT

CROSS REFERENCE TO RELATED APPLICATIONS

This application claims the benefit of Provisional Application Ser. No. 60/114,485, filed Dec. 31, 1998.

BACKGROUND OF THE INVENTION

1. Field of the Invention

This invention relates to a vacuum cleaner. In one of its aspects, the invention relates to a handle/support assembly for an upright vacuum cleaner with a snap-fit handle construction. In another of its aspects, the invention relates to a torque resistant handle/support assembly for an upright vacuum cleaner.

2. Description of the Related Art

Known upright vacuum cleaners include a pivotal handle assembly that is detachably secured to a base module. To alleviate packaging constraints, the handle portion is typically shipped separately from the base module such that they must be assembled together once received from the manufacturer. One known handle, as disclosed in U.S. Pat. Nos. 5,761,763 and 5,500,977, provides an upper handle portion that is telescopically mounted over attachment posts extending from an upper end of a lower body shell. The upper handle portion and the lower body shell are secured to one another by passing screws through the handle portion.

In another known handle construction, as disclosed in U.S. Pat. Nos. 4,648,149 and 4,621,390, an upper handle portion and a lower handle portion have attachment openings which are manipulated into alignment as the portions are assembled. The lower handle portion has attachment openings on an upper section, wherein the upper section is telescopically received within an opening in the upper handle portion that has mating attachment openings. After insertion of the lower handle portion, either the upper or lower handle portions are manipulated to insure that the attachment openings are properly aligned. Once aligned, separate snap pins are then pressed through the attachment openings to properly secure the two portions together.

These techniques for securing the handle are undesirable as they require separate attachment fasteners, which may become misplaced during shipping or assembly. Further, if the fastener breaks, an additional fastener must be obtained to properly secure the handle, causing inconvenience to the user at best and a permanently defective handle assembly at worse. In some instances assembly of the handle further requires a special tool to properly secure the fastener to the handle.

Often the handle assembly must also serve as a support for a vacuum cleaner module. In one such vacuum cleaner, as disclosed in U.S. Pat. No. 5,309,600, the handle assembly includes a unitary support member that spans substantially the width of the base module. This type of support member does not provide a means for accommodating a rearwardly extending vacuum hose from the vacuum module.

In another known handle assembly, as disclosed in PCT Publication No. WO 94/17716, an elongated support member is laterally offset from the center of the base module. While this arrangement overcomes the difficulties associated with positioning rearwardly extending vacuum hoses, the torque resistance of the handle during operation of the vacuum cleaner is reduced.

SUMMARY OF THE INVENTION

These and other problems of the prior art are overcome with a snap-in handle for a handle/support assembly, wherein the handle/support assembly substantially reduces torquing of the vacuum module relative to the support member.

According to the invention, a handle assembly for an upright vacuum cleaner comprises a primary support member having an upper handle-mounting portion, a body portion and a foot portion adapted to be mounted to a base member. A handle section is telescopingly received on the upper handle-mounting portion of the primary support member. One of the handle section and the primary support member have at least one projecting mounting tab and the other of the handle section and the primary support member have at least one slot in registry with and receiving the at least one projecting mounting tab to retain the handle section on the primary support member. In this way, the two handle sections are snap-fit together without the use of any tools. Preferably, there are two mounting tabs and two slots in registry with the mounting tabs. Further the handle section and the upper handle-mounting portions are rectangular in horizontal cross-sectional configuration for rotational rigidity. In one embodiment, the mounting tabs are mounted on the upper handle-mounting portion and the slots are provided in the handle section. Preferably, the mounting tabs are integrally formed with one of the handle section and the primary support member. In a preferred embodiment, the mounting tabs are in the form of fingers that are formed by integral U-shaped slots in the one of the handle section and the primary support member.

In a preferred embodiment, the primary support member is an inverted L-shape in profile. Preferably, a secondary support member is adapted to mount between the base and the overhanging portion of the primary support member.

In another preferred embodiment, the primary support member has a pair of integrally molded projections extending downwardly from the foot portion thereof for mounting the primary support member to a base. The projections are integrally formed by vertically extending flanges. Tool-mounting projections are also preferably integrally formed with and extend from either side of the primary support member.

In accordance with a preferred embodiment of the invention, the body section is positioned laterally of a vacuum hose opening in the base. The secondary support leg is positioned adjacent to but spaced from the body section to provide space for a vacuum hose between the base and a vacuum module which is mounted to the handle and to the base. The secondary support member gives torsional resistance to the handle assembly.

BRIEF DESCRIPTION OF THE DRAWINGS

The invention will now be described with reference to the drawings in which.

DETAILED DESCRIPTION OF THE PREFERRED EMBODIMENTS

Figure 1:
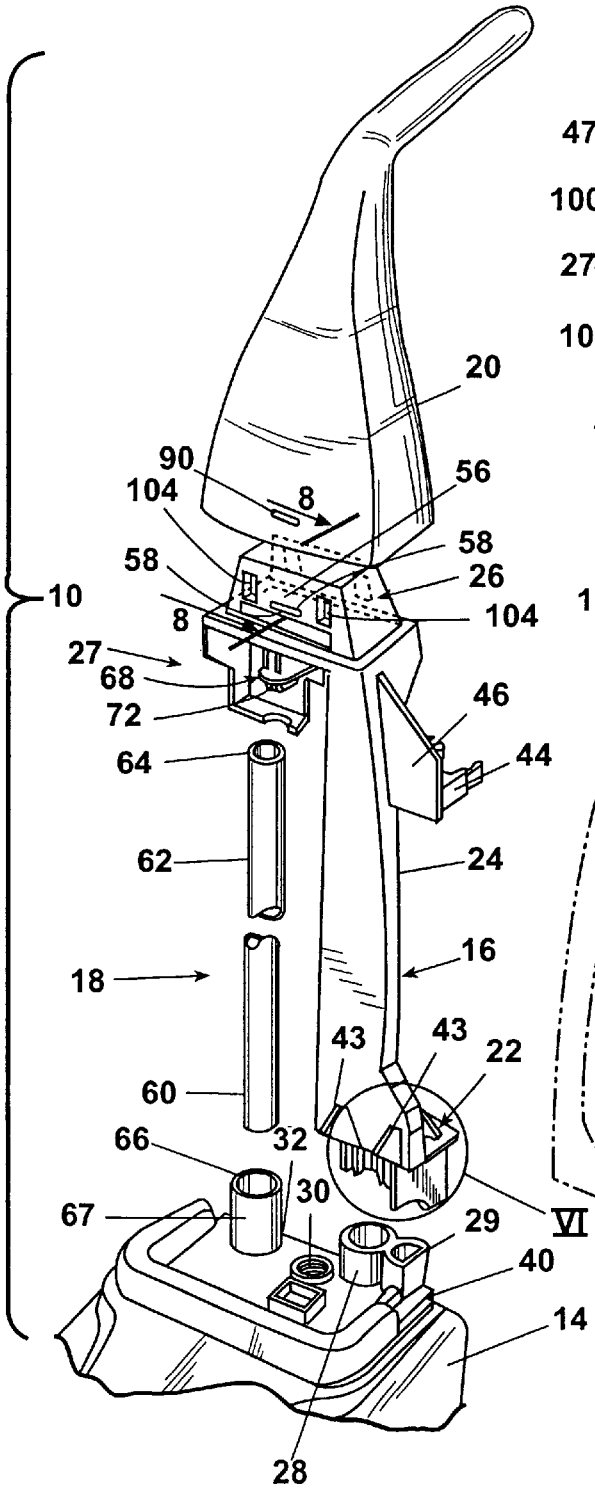
FIG. 1 is a partially exploded view of an upright vacuum cleaner according to the invention.
Figure 2:
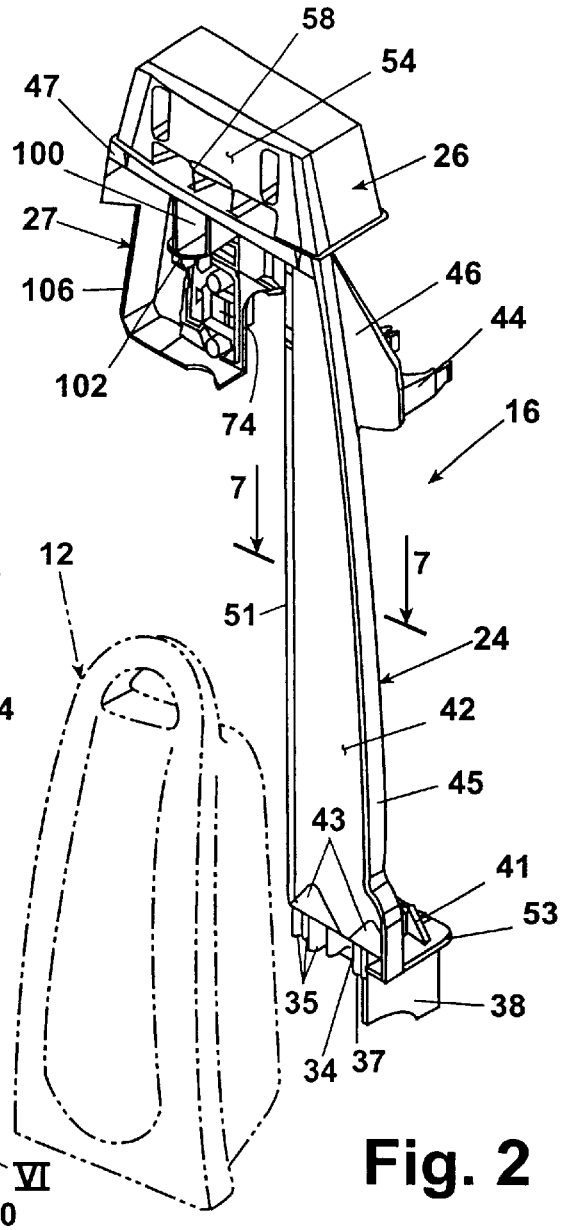
FIG. 2 is a perspective view of a primary support member for a handle/support assembly of a vacuum cleaner illustrated in FIG. 1.

Referring now to the drawings and to FIG. 1 in particular, an upright vacuum cleaner comprises a handle/support assembly 10, a vacuum module 12 (shown in phantom) and a base housing 14. The vacuum module 12 and the base housing 14 are disclosed in more detail in PCT Publication No. WO 94/17716, which is incorporated herein by reference. The vacuum module 12 and the base housing 14 form no part of this invention except to the extent that they are used with the handle/support assembly 10 according to the invention and thus will not be described in detail in this application. In accordance with the invention, handle/support assembly 10 includes a primary support member 16, a secondary support member 18 and a detachable handle section 20. As seen best in FIGS. 2 and 3, primary support member 16 has a foot member 22, a body section 24, a handle mounting section 26 and a secondary support leg 27. Foot member 22 is releasably securable in a first mounting tube 28 of base housing 14. First mounting tube 28 is positioned so as to be laterally offset from a vacuum hose opening 30 disposed generally in the center of a back portion 32 of base housing 14. In one embodiment, foot member 22 is provided with integral retainers 34 that have an inclined lower surface and a lateral shoulder that is received beneath the lower edges of mounting tubes 28 and 29. Foot member 22 further includes a guide flange 38 to support the primary support member 16 on the base housing 14. Guide flange 38 is receivable within a slot 40 that is positioned adjacent to first mounting tube 28 in base housing 14. Three depending flanges 35 form a circular guide which is received in the first mounting tube 28 and two depending flanges 37 fit into a semicylindrical mounting tube 29 on the base 14. The depending flanges 35 in the mounting tube 28 and the depending flange 37 in the semicylindrical mounting tube 29 and the guide flange 38 in the slot 40 give significant lateral support for the connection of the handle body section 24 to the base housing 14 while the retainer 34 retains the handle 10 in the base housing 14. The foot member 22 further has a pair of rectangular openings 39 aligned with the depending flanges 35 and 37 to assist in molding the flanges. The flanges 35 and 37 are joined at the back edges thereof by integral webs 55 and 57, respectively. The foot 22 further has a pair of upstanding X-shaped projections 41 on a lateral shelf 53.

Figure 3:
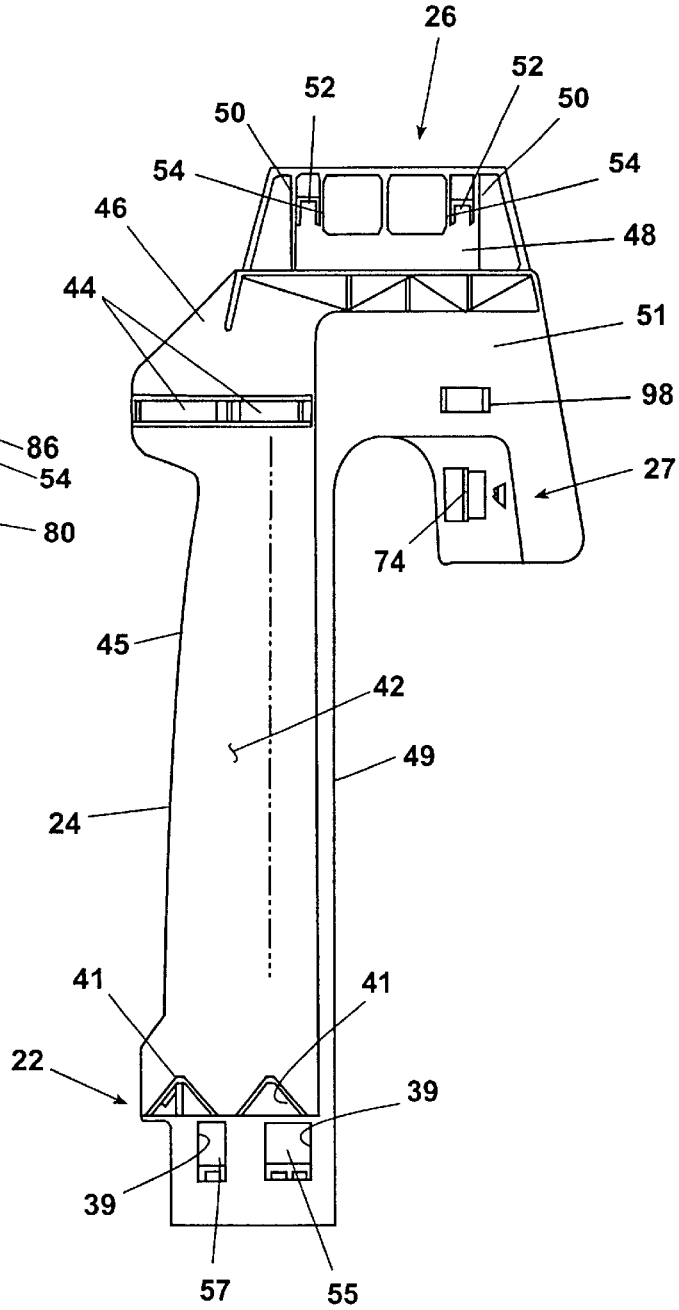
FIG. 3 is a rear elevational view of the primary support member in FIG. 2 from a rearward direction.

Body section 24 has a generally upright front support section 42 that is laterally offset from vacuum hose opening 30, to avoid interference with attachment of a rear extending vacuum hose (not shown) to base housing 14. A flange 45 extends rearwardly from the side of the front support section 42 and a flange 49 extends forwardly of the front support section. A wall 51 extends laterally from the flange 45. Referring to FIG. 3, one or more mounting brackets 44 on a rearward side of body section 24 are integrally formed with the primary support member 16 to selectively mount vacuum cleaner wands or the like (not shown). The wands are mounted at the lower ends on the integrally formed X-shaped protrusions 41. An upper portion 47 of body section 24 is integrally formed with handle mounting section 26. One wall 48 of handle mounting section 26 has U-shaped slots 50 that define integral, spaced apart resilient spring fingers 52 having rearwardly projecting mounting tabs 54 at the upper ends thereof. Mold openings 104 extend through a front wall 56 to the slots 50. The front wall 56 of handle mounting section 26 has an integrally formed fixed tab 58 projecting forwardly. Mounting tabs 54 and fixed tab 58 will be described below in greater detail.

A pair of triangular openings is formed in the bottom portion of section 42 adjacent to the X-shaped projections 41 to assist in molding the projections 41.

Secondary support leg 27, which has a length that is substantially less than the length of body section 24, comprises an upper portion of the wall 49, a forwardly directed rim 106 and molded projections 102 which terminate in a tube supporting receiver 68. The secondary support leg 27 is integrally formed with handle mounting section 26 and positioned adjacent to body section 24. A latch member 74 that cooperates with a latch mechanism (not shown) disposed on vacuum module 12 is formed in the upper portion of the wall 49 to secure vacuum module 12 to primary support member 16 in a manner disclosed in the Weaver et al. U.S. Pat. No. 5,309,600 which is incorporated herein by reference.

Secondary support member 18 has a lower end 60, a body section 62 and an upper end 64, as seen in FIG. 1. Lower end 60 is releasably securable in a telescoping manner within second mounting tube 66 of base housing 14. Second mounting tube 66 is spaced laterally from vacuum hose opening 30, opposite first mounting opening 28 to provide a space for the passage of the vacuum hose from the base housing 14 to the vacuum module 12 as illustrated in PCT Publication No. WO 94/17716. Upper end 64 is releasably securable to a receiver 68 to integrate primary and secondary support members 16 and 18. Secondary support member 18 is preferably a hollow metal tube.

In accordance with one aspect of the present invention, primary and secondary support members 16 and 18, respectively, cooperate to increase the structural integrity of handle/support assembly 10 by providing an integrated support structure for vacuum module 12 that extends substantially across the width of base housing 14. Therefore, any torquing of vacuum module 12 relative to primary support member 16 during use of the vacuum cleaner assembly is substantially reduced. Further, primary and secondary support members 16 and 18 define a generally rectangular aperture 76 therebetween, which easily accommodates a rearwardly extending vacuum hose (not shown) extending from vacuum module 12.

Figure 4:
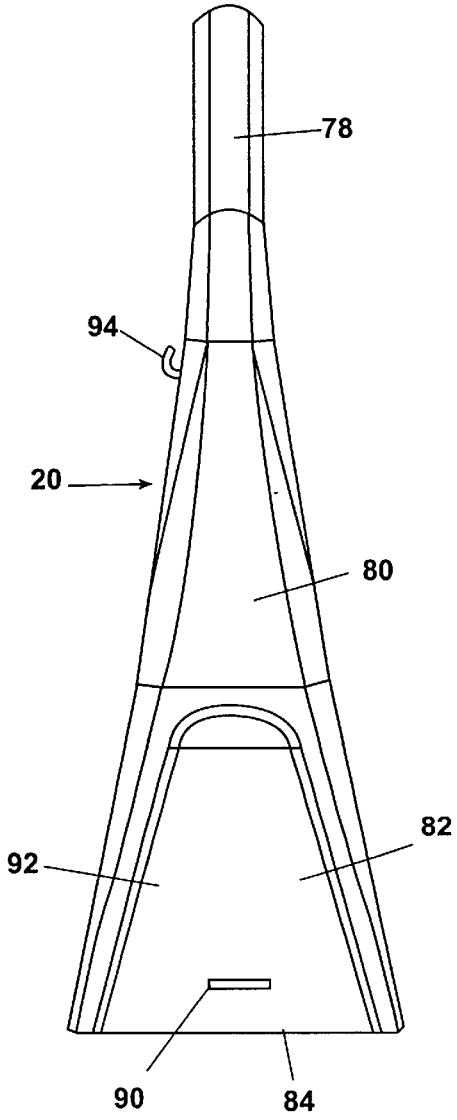
FIG. 4 is a front elevational view of a handle section of the handle/support assembly.
Figure 5:
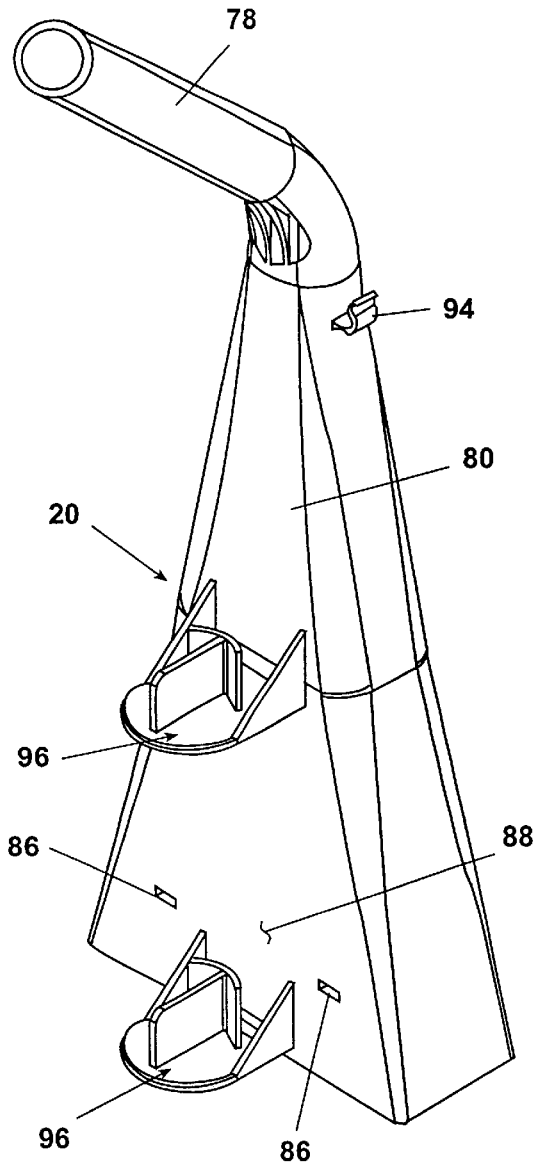
FIG. 5 is a perspective view of the handle section in FIG. 4.
Figure 6:
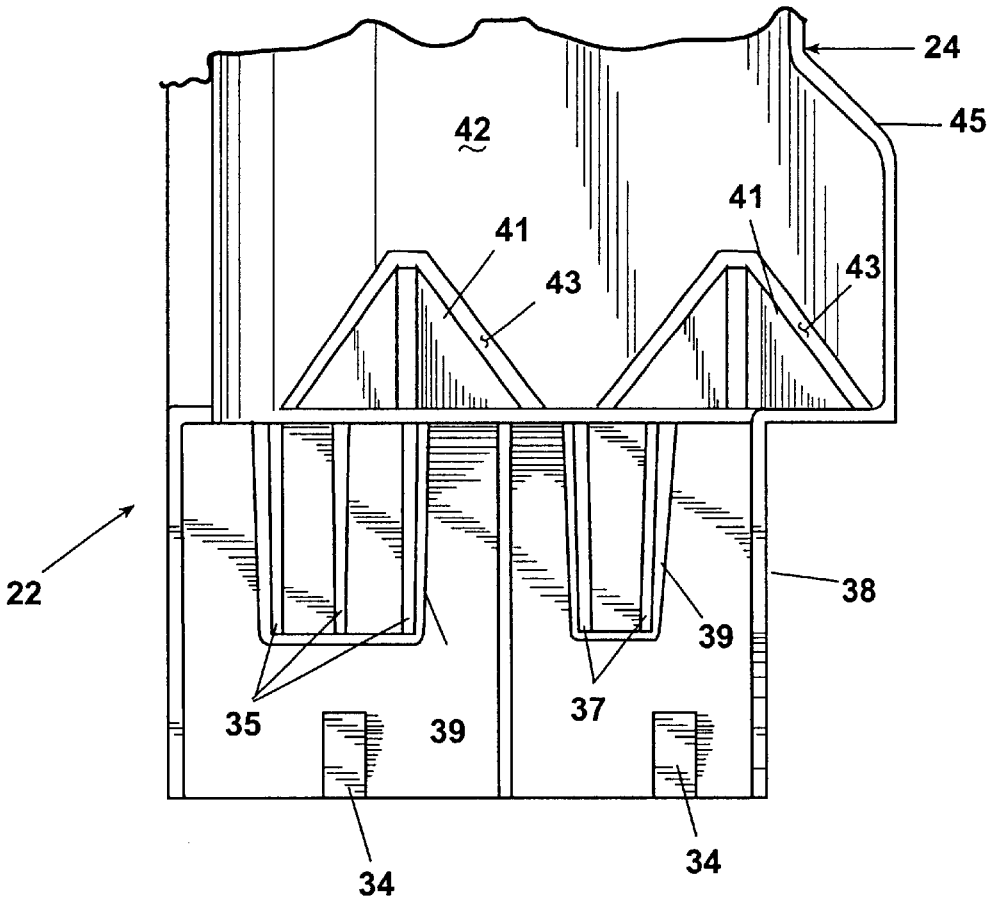
FIG. 6 is an enlarged rear elevation of the lower portion of the handle in the circle VI of FIG. 2.
Figure 7:
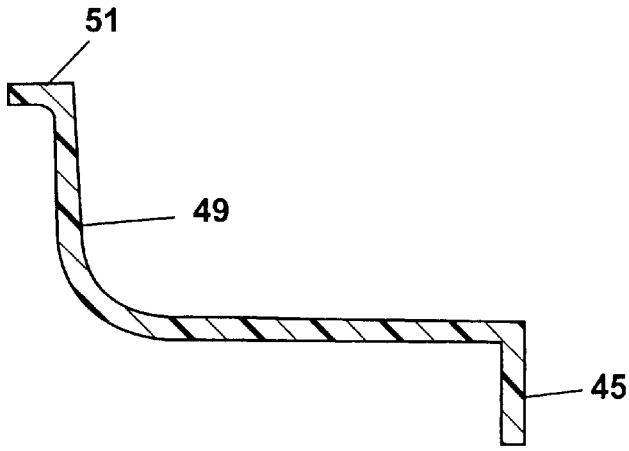
FIG. 7 is a cross-sectional view taken along lines 7—7 of FIG. 2.

Referring to FIGS. 4 and 5, handle/support assembly 10 further includes a contoured handle section 20 that is easily and quickly securable to handle mounting section 26 of primary support member 16 through snap fasteners without the use of tools. In one embodiment, handle section 20 comprises a gripping portion 78, a center portion 80 and a base portion 82, all of which are integrally formed as a one-piece unit.

Gripping portion 78 extends upwardly at an acute angle, away from the remainder of handle section 20. The gripping portion 78 has a generally tubular shape and can be provided with a plurality of ridges (not shown) to prevent a user's hand from slipping.

Figure 8:
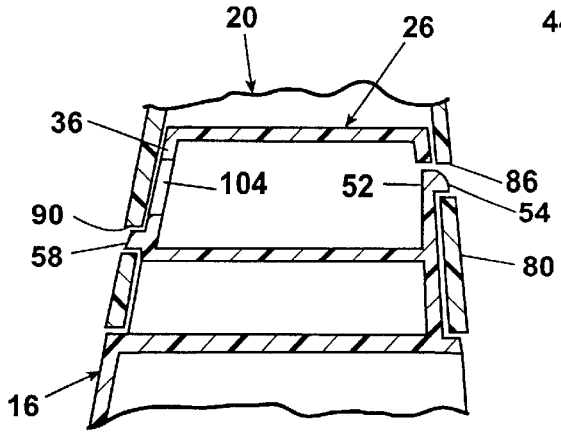
FIG. 8 is a sectional view of an assembled handle taken along lines 8—8 of FIG. 1.

In accordance with another aspect of the invention, base portion 82 has an open end 84 shaped and sized to complement the external shape of handle mounting section 26 such that handle mounting section 26 is telescopically received within base portion 82. To secure handle section 20 to primary support member, base portion 82 has spaced apart finger slots 86 disposed in a rear wall 88, as seen in FIG. 5, and a tab slot 90 disposed in a front wall 92, positioned opposite rear wall 88, as seen in FIG. 4. Finger slots 86 are adapted to receive mounting tabs 54 and tab slot 90 is adapted to receive fixed tab 58 when handle mounting section 26 is telescopically received with open end 84 base portion 82. Thus, base portion 82 of handle section 20 snaps into position on primary support member 16 without requiring separate fasteners or the use of tools as illustrated in FIG. 8. Whereas the invention has been described with respect to two finger slots 86 and two mounting tabs 54, it is within the scope of the invention to use one or more finger slot and mounting tab combinations to secure the handle section 20 to the primary support member 16. Thus, one, three or more finger slot and mounting tab combinations can be used for this purpose according to the invention. Further, the mounting tabs 54 have been described as mounted on resilient fingers. It is preferred in some applications to eliminate the U-shaped slots 50 and the resilient mounting fingers 52, and integrally mold the mounting tabs 54 directly to the wall 48 of the handle mounting section 26.

Handle section 20 can further include an integrally molded cord mount 94, shown formed on center portion 80, for conveniently storing an electrical cord. One or more C-shaped mounts 96 can also be integrally molded to the handle section 20 and or the primary support member for selectively mounting vacuum cleaner attachment accessories (not shown) such as upholstery brushes and the like.

Figure 9:
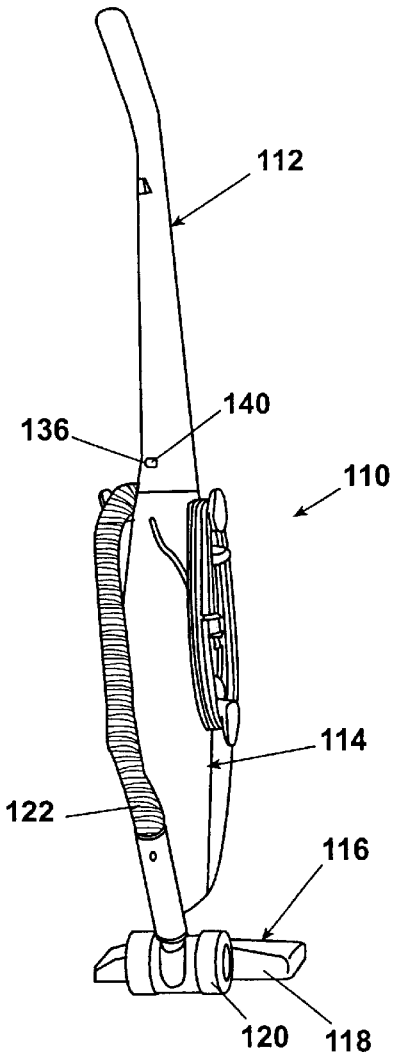
FIG. 9 is a rear perspective view of a second embodiment of the invention.
Figure 10:
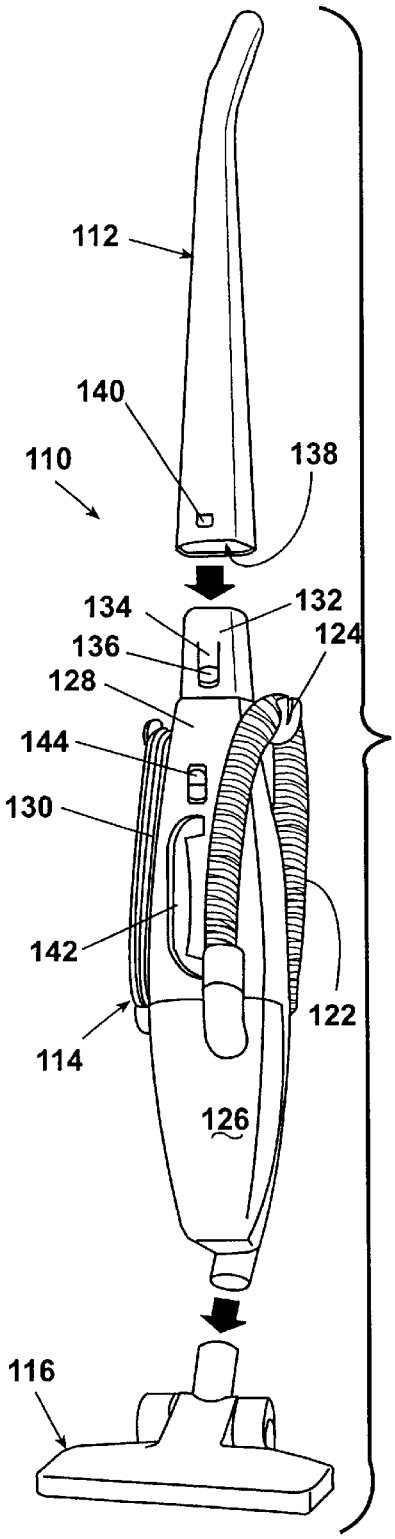
FIG. 10 is an exploded front perspective view of the second embodiment of the invention illustrated in FIG. 9.

Referring now to FIGS. 9 and 10, a stick vacuum cleaner 110 has an upper handle section 112, a body section 114 and a suction foot section 116, all connected together. The foot section 116 comprises a suction nozzle 118 and wheels 120. A hose 122 connects the suction nozzle 118 with a filter housing 126 on the body section 114. The hose is supported by a hook 124. The body section 114 further comprises a motor housing 128 which houses a motor which draws air passing through the hose 122 through a filter (not shown) in the filter housing 122. The motor is powered by electricity which is supplied through an electrical cord 130, shown coiled on supports on the body section 114. The body section 114 further has a hollow handle mounting section 132 at an upper portion thereof. A resilient finger 134 having a projection 136 is integrally formed in the handle-mounting section in the same manner as the resilient fingers 52 are formed in the handle-mounting section 26 of the first embodiment. Preferably, the resilient fingers 114, including the projections 136, are formed both on the front and rear portions of the handle-mounting section 132 in an identical fashion. The body section 114 further includes a carry handle 142 and a switch 144.

The handle section 112 is hollow and has a lower opening 138 at a bottom portion thereof. The lower opening 138 is sized to telescopically slide onto the handle-mounting section 132 of the body section 114. Openings 140 are formed in both the front and rear side of the handle section 112 at a lower portion thereof and in registry with the projections 136 of the resilient fingers 134 when the handle section 112 is firmly seated on the handle-mounting section 132 of the body section 114.

The handle section 112 is assembled to the body section 114 by simply sliding the lower opening 138 of the handle section 112 onto the handle-mounting section 132. The resilient fingers 134 are resiliently depressed during the movement of the handle section 112 onto the handle-mounting section 132 until the projections 136 are aligned with the openings 140. The projections 136 then snap into the openings 140. The openings 140 are sized to snugly receive the projections 136 so that the handle section 112 is firmly retained on the body section 114 through the projections 136 on the resilient fingers 132. The handle section 112 can be easily removed from the body section 114 by simply pushing the projections 136 inwardly and pulling the handle section 112 away from the body section 114.

The stick vacuum cleaner 112 illustrated in FIGS. 9 and 10 is conventional in the suction foot section 116 and the body section 114. The handle section 112 is also conventional with the exception of the snap-fit fingers in the handle-mounting section 132 and the openings in the handle section 112. The suction and filtration system of the stick vacuum cleaner 110 forms no part of this invention and, accordingly, will not be more specifically described.

Whereas the invention has been described with reference to vacuum cleaners, the term "vacuum cleaner" is used in a generic sense to include both dry vacuum cleaners and wet vacuum cleaners, including extraction vacuum cleaners. Examples of extraction vacuum cleaners are disclosed, for example, in the McAllise et al. U.S. Pat. No. 5,500,977, issued Mar. 26, 1996, and in the U.S. patent to Kasen et al., U.S. Pat. No. 5,937,475, issued Aug. 17, 1999, both of which patents are incorporated herein by reference.

Preferred embodiments of the present invention have been disclosed. Reasonable variation and modification are possible within the scope of the forgoing disclosure and drawings without departing from the scope of the invention which is defined in the appended claims.

What is claimed is:

1. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having two mounting tabs and the other of the handle section and the primary support member having two slots in registry with the mounting projecting tabs and receiving the projecting mounting tabs to retain the handle section on the primary support member.

2. A handle assembly according to claim 1 wherein the mounting tabs are resiliently mounted and are snap-fit into the slots.

3. A handle assembly according to claim 2 wherein the mounting tabs are integrally formed with one of the handle section and the primary support member.

4. A handle assembly according to claim 3 wherein the mounting tabs project from fingers which are formed by integral U-shaped slots in one of the handle section and the primary support member.

5. A handle assembly according to claim 4 wherein the mounting tabs are formed in the primary support member and the slots are formed in the handle section.

6. A handle assembly according to claim 5 wherein the primary support member is inverted L-shaped in profile.

7. A handle assembly according to claim 6 and further comprising a pair of integrally molded projections extending downwardly from a lower portion of the foot portion for mounting the primary support member in the base.

8. A handle support assembly according to claim 7 wherein the projections are formed by vertically extending flanges.

9. A handle-mounting assembly according to claim 8 and further comprising tool-mounting projections integrally formed with and extending from a rear side of the primary support member.

10. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having at least one projecting mounting tab and the other of the handle section and the primary support member having at least one slot in registry with and receiving the at least one projecting mounting tab to retain the handle section on the primary support member, wherein the at least one mounting tab is resiliently mounted and adapted to snap-fit into the at least one slot, and is integrally formed with the one of the handle section and the primary support member.

11. A handle assembly according to claim 10 wherein the at least one mounting tab is formed on one of a front surface and back surface of the one of the handle section and the primary support member and further comprising a fixed tab mounted on the other of the front surface and back surface of one of the handle section and the primary support member and a slot formed on the other of the handle section and the primary support member in registry with the fixed tab to retain the handle section on the primary support.

12. A handle assembly according to claim 6 and further comprising a secondary support member adapted to mount between the base and an overhanging portion of the primary support member.

13. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having at least one projecting mounting tab and the other of the handle section and the primary support member having at least one slot in registry with and receiving the at least one projecting mounting tab to retain the handle section on the primary support member, wherein the at least one mounting tab projects from a finger which is formed by an integral U-shaped slot in the one of the handle section and the primary support member.

14. A handle assembly according to claim 13 wherein the at least one mounting tab is formed in the primary support member and the at least one slot is formed in the handle section.

15. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having at least one projecting mounting tab and the other of the handle section and the primary support member having at least one slot in registry with and receiving the at least one projecting mounting tab to retain the handle section on the primary support member;

wherein the primary support member is an inverted L-shape in profile.

16. A handle assembly according to claim 15 and further comprising a secondary support member adapted to mount between the base and an overhanging portion of the primary support member.

17. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having at least one projecting mounting tab and the other of the handle section and the primary support member having at least one slot in registry with and receiving the at least one projecting mounting tab to retain the handle section on the primary support member;

and further comprising a pair of integrally molded projections extending downwardly from a lower portion of the primary support member for mounting the primary support member on the base.

18. A handle assembly according to claim 17 wherein the projections are formed by vertically extending flanges.

19. A handle assembly for an upright vacuum cleaner comprising:

a primary support member having an upper handle-mounting portion, a body portion and a foot portion that is adapted to be mounted to a base member;

a handle section telescopingly received on the upper handle-mounting portion of the primary support member; and one of the handle section and the primary support member having at least one projecting mounting tab and the other of the handle section and the primary support member having at least one slot in registry with and receiving the at least one projecting mounting tab to retain the handle section on the primary support member; and further comprising tool-mounting projections integrally formed with and extending from a rear side of the primary support member.

20. A vacuum cleaner assembly having a base member and a handle mounted to the base member, the handle comprising:

a primary support member having an upper handle-mounting portion and a foot portion that is mounted to the base member;

a handle section telescopingly received on the upper handle-mounting portion of the primary support member; and one of the handle section and the primary support member having at least one projecting mounting tab and the other of the handle section and the primary support member having at least one slot in registry with and receiving the outwardly projecting mounting tabs to retain the handle section on the primary support member without the use of separate fasteners or tools, wherein the at least one projecting mounting tab and the at least one slot are two mounting tabs and two slots in registry with the mounting tabs.

21. A vacuum cleaner assembly according to claim 20 wherein at least one of the mounting tabs are resiliently mounted and are snap-fit into the slots.

22. A vacuum cleaner assembly according to claim 21 wherein the mounting tabs are integrally formed with one of the handle section and the primary support member.

23. A vacuum cleaner assembly according to claim 22 wherein the mounting tabs project from fingers which are formed by integral U-shaped slots in one of the handle section and the primary support member.

24. A vacuum cleaner assembly according to claim 23 wherein the mounting tabs are formed in the primary support member and the slots are formed in the handle section.

25. A vacuum cleaner assembly having a base member and a handle pivotally mounted to the base member, the handle comprising:

a primary support member having an upper handle-mounting portion and a foot portion that is mounted to the base member;

a handle section telescopingly received on the upper handle-mounting portion of the primary support member; and one of the handle section and the primary support member having at least one projecting mounting tab and the other of the handle section and the primary support member having at least one slot in registry with and receiving the outwardly projecting mounting tabs to retain the handle section on the primary support member without the use of separate fasteners or tools;

wherein the at least one mounting tab is integrally formed with one of the handle section and the primary support member.

* * * * *